US012276006B2

(12) United States Patent
Yamamoto et al.

(10) Patent No.: US 12,276,006 B2
(45) Date of Patent: Apr. 15, 2025

(54) METHOD OF PRODUCING HIGH-STRENGTH HOT-DIP GALVANIZED STEEL SHEET

(71) Applicant: JFE STEEL CORPORATION, Tokyo (JP)

(72) Inventors: Shunsuke Yamamoto, Tokyo (JP); Shotaro Terashima, Tokyo (JP); Yuki Takeda, Tokyo (JP); Michitaka Sakurai, Tokyo (JP); Katsuya Hoshino, Tokyo (JP); Yoshiyasu Kawasaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 415 days.

(21) Appl. No.: 17/760,362

(22) PCT Filed: Nov. 19, 2020

(86) PCT No.: PCT/JP2020/043279
§ 371 (c)(1),
(2) Date: Aug. 9, 2022

(87) PCT Pub. No.: WO2021/166350
PCT Pub. Date: Aug. 26, 2021

(65) Prior Publication Data

US 2023/0082367 A1 Mar. 16, 2023

(30) Foreign Application Priority Data

Feb. 21, 2020 (JP) ..... 2020-028717

(51) Int. Cl.
*C21D 9/46* (2006.01)
*C21D 1/26* (2006.01)
(Continued)

(52) U.S. Cl.
CPC ..... *C21D 9/46* (2013.01); *C21D 1/26* (2013.01); *C21D 6/001* (2013.01); *C21D 6/002* (2013.01);
(Continued)

(58) Field of Classification Search
None
See application file for complete search history.

(56) References Cited

U.S. PATENT DOCUMENTS 8,241,759 B2 8/2012 Nakagaito et al.
10,138,530 B2 11/2018 Makimizu et al.
(Continued)

FOREIGN PATENT DOCUMENTS

CN 101287854 A 10/2008
CN 103282532 A 9/2013
(Continued)

OTHER PUBLICATIONS

Characterization of surface layers of oxidation-reduction treated Si and Mn added advanced high strength steel (Year: 2020).*
(Continued)

*Primary Examiner* — Jenny R Wu
(74) *Attorney, Agent, or Firm* — KENJA IP LAW PC

(57) ABSTRACT

To obtain a high-strength hot-dip galvanized steel sheet having excellent surface appearance even in the case where a steel strip containing Mn at a predetermined ratio or more to Si is subjected to hot-dip galvanizing treatment, a method of producing a hot-dip galvanized steel sheet using a continuous hot-dip galvanizing apparatus comprises: subjecting a steel strip to annealing, by conveying it in an annealing furnace; and subjecting the steel strip discharged from a cooling zone to hot-dip galvanizing using a hot-dip galvanizing line, to obtain a hot-dip galvanized steel sheet. The steel strip has a chemical composition containing, in mass
(Continued)

%, Mn: 1.7% or more and 3.5% or less and Si: 0.2% or more and 1.05% or less and satisfying [Si]/[Mn]≤0.30. The chemical composition, a dew point of an atmosphere in the soaking zone, and a delivery temperature of the heating zone satisfy Formula (1).

8 Claims, 9 Drawing Sheets

(51) Int. Cl.

| | |
|---|---|
| ***C21D 6/00*** | (2006.01) |
| ***C22C 38/00*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/28*** | (2006.01) |
| ***C22C 38/32*** | (2006.01) |
| ***C22C 38/38*** | (2006.01) |
| ***C23C 2/02*** | (2006.01) |
| ***C23C 2/28*** | (2006.01) |
| ***C23C 2/40*** | (2006.01) |

(52) U.S. Cl.
CPC ..... *C21D 6/005* (2013.01); *C21D 6/008* (2013.01); *C22C 38/001* (2013.01); *C22C 38/002* (2013.01); *C22C 38/02* (2013.01); *C22C 38/06* (2013.01); *C22C 38/08* (2013.01); *C22C 38/12* (2013.01); *C22C 38/16* (2013.01); *C22C 38/28* (2013.01); *C22C 38/32* (2013.01); *C22C 38/38* (2013.01); *C23C 2/02* (2013.01); *C23C 2/022* (2022.08); *C23C 2/0224* (2022.08); *C23C 2/024* (2022.08); *C23C 2/28* (2013.01); *C23C 2/40* (2013.01)

(56) References Cited

U.S. PATENT DOCUMENTS

| | | | |
|---|---|---|---|
| 2009/0123651 | A1 | 5/2009 | Okada |
| 2013/0177780 | A1 | 7/2013 | Park et al. |
| 2014/0144550 | A1 | 5/2014 | Blumenau et al. |
| 2014/0174608 | A1 | 6/2014 | Miyata et al. |
| 2017/0130296 | A1 | 5/2017 | Takeda et al. |
| 2018/0051356 | A1* | 2/2018 | Takeda ..... C23C 2/004 |
| 2019/0242000 | A1 | 8/2019 | Makimizu et al. |

FOREIGN PATENT DOCUMENTS

| | | | |
|---|---|---|---|
| CN | 103597102 | A | 2/2014 |
| JP | 2008266778 | A | 11/2008 |
| JP | 2013136809 | A | 7/2013 |
| JP | 2016053211 | A | 4/2016 |
| JP | 2016084543 | A | 5/2016 |
| KR | 1020120075260 | A | 7/2012 |
| KR | 1020140007476 | A | 1/2014 |
| KR | 1020190057335 | A | 5/2019 |
| WO | 2007043273 | A1 | 4/2007 |
| WO | 2018079124 | A1 | 5/2018 |

OTHER PUBLICATIONS

Jan. 12, 2021, International Search Report issued in the International Patent Application No. PCT/JP2020/043279.

Jan. 18, 2022, Notification of Reasons for Refusal issued by the Japan Patent Office in the corresponding Japanese Patent Application No. 2021-517715 with English language Concise Statement of Relevance.

Nov. 28, 2023, Office Action issued by the China National Intellectual Property Administration in the corresponding Chinese Patent Application No. 202080095133.5 with English language search report.

Jul. 5, 2023, the Extended European Search Report issued by the European Patent Office in the corresponding European Patent Application No. 20919890.2.

Aug. 5, 2024, Office Action issued by the Korean Intellectual Property Office in the corresponding Korean Patent Application No. 10-2022-7027230 with English language concise statement of relevance.

* cited by examiner

METHOD OF PRODUCING HIGH-STRENGTH HOT-DIP GALVANIZED STEEL SHEET

TECHNICAL FIELD

The present disclosure relates to a method of producing a high-strength hot-dip galvanized steel sheet having, as a base metal, a high-strength steel sheet containing Si and Mn.

BACKGROUND

In fields such as automobiles, home electric appliances, and building materials, steel sheets surface-treated to impart rust resistance are used. In particular, hot-dip galvanized steel sheets and galvannealed steel sheets which can be produced at low costs and have excellent rust resistance are used. A hot-dip galvanized steel sheet is typically produced by the following method: First, a steel slab is subjected to hot rolling and cold rolling and optionally heat treatment to obtain a thin steel sheet as a base steel sheet. The surface of the base steel sheet is cleaned by a pretreatment process including degreasing and/or pickling, or, without the pretreatment process, oil on the surface of the base steel sheet is removed by combustion in a preheating furnace. After this, the base steel sheet is subjected to recrystallization annealing that involves heating in a non-oxidizing atmosphere or a reducing atmosphere. The steel sheet is then cooled to a temperature suitable for coating in the non-oxidizing atmosphere or the reducing atmosphere, and, without being exposed to the air, immersed in a hot-dip zinc bath (hot-dip galvanizing bath) to which a slight amount of Al has been added. A galvannealed steel sheet is produced by, after the hot-dip galvanizing, heat-treating the steel sheet in an alloying furnace to alloy the coating layer.

In recent years, weight reduction of steel sheets is promoted, and strengthening of steel sheets is demanded. Hence, high-strength hot-dip galvanized steel sheets having rust resistance are increasingly used. An effective way of strengthening steel sheets is to add solid-solution-strengthening elements such as Si and Mn. High-strength steel sheets used in automobiles need to be press formed, and accordingly it is necessary to improve the balance between strength and ductility. Si and Mn are advantageous in that they contribute to higher strength of steel without loss of ductility. Steel containing Si and Mn is therefore very useful as high-strength steel sheets. However, the following problem arises in the case of producing a high-strength hot-dip galvanized steel sheet using, as a base metal, steel containing Si and Mn.

Si and Mn form oxide in the steel sheet outermost layer in the annealing atmosphere, and degrade the wettability between the base steel sheet and the hot-dip zinc. Hence, in the case of producing a high-strength hot-dip galvanized steel sheet using, as a base metal, steel containing Si and Mn, there is a possibility that the resultant high-strength hot-dip galvanized steel sheet has poor surface appearance and has a surface defect such as a non-coating defect. Such a surface defect is considered to be caused by the oxide of Si and Mn, which has been formed in the steel sheet outermost layer, remaining at the interface between the coating layer and the base steel sheet. In view of this problem, JP 2016-53211 A (PTL 1) discloses a technique of, when using a high-strength steel sheet containing Si and Mn as a base metal, performing oxidation treatment and then performing reduction annealing in order to suppress the oxidation of Si and Mn in the steel sheet outermost layer which causes degradation in the wettability between the base steel sheet and the hot-dip zinc.

CITATION LIST

Patent Literature

PTL 1: JP 2016-53211 A

SUMMARY

Technical Problem

The method of performing oxidation treatment and then performing reduction annealing as described in PTL 1 is effective in preventing the oxidation of Si and Mn in the steel sheet outermost layer. In the case where Mn is added at a predetermined ratio or more to Si, however, the surface appearance degrades depending on the reduction annealing conditions. It is known that Si and Mn tend to form complex oxide. In the case where Mn is added excessively relative to Si, excess Mn singly forms a large amount of oxide in the steel sheet outermost layer, as a result of which the surface appearance degrades. This is not taken into consideration in PTL 1.

It could therefore be helpful to obtain a high-strength hot-dip galvanized steel sheet having excellent surface appearance even in the case where a steel strip containing Mn at a predetermined ratio or more to Si is subjected to hot-dip galvanizing treatment.

Solution to Problem

As a result of repeated study, we discovered the following: In the case where a high-strength steel sheet containing Si and Mn is used as a base metal, an effective way of suppressing the oxidation of Si and Mn in the steel sheet outermost layer which causes a decrease in the wettability between the steel sheet and the hot-dip zinc is to perform oxidation treatment and then perform reduction annealing. In the case where Mn is added excessively relative to Si, by appropriately controlling the delivery temperature in the oxidation treatment and the dew point in the reduction annealing, the oxidation of Si and Mn at the steel sheet surface can be suppressed and a high-strength hot-dip galvanized steel sheet having excellent surface appearance can be obtained.

The present disclosure is based on these discoveries. We thus provide:

[1] A method of producing a high-strength hot-dip galvanized steel sheet using a continuous hot-dip galvanizing apparatus including an annealing furnace in which a heating zone, a soaking zone, and a cooling zone are arranged side by side in the stated order and a hot-dip galvanizing line located downstream of the cooling zone, the method comprising: subjecting a steel strip to annealing, by conveying the steel strip in the annealing furnace in an order of the heating zone, the soaking zone, and the cooling zone; and subjecting the steel strip discharged from the cooling zone to hot-dip galvanizing using the hot-dip galvanizing line, to obtain a high-strength hot-dip galvanized steel sheet, wherein the steel strip has a chemical composition containing (consisting of), in mass %, Mn: 1.7% or more and 3.5% or less and Si: 0.2% or more and 1.05% or less and satisfying [Si]/[Mn]≤0.30, and the chemical composition, a dew point of an atmosphere in the soaking zone, and a delivery temperature of the heating zone satisfy the following Formula (1):

$$A\times 50+B-C/30<140 \quad (1)$$

where A=[Mn]−[Si]×4,

B=−0.0068×(D.P.)$^3$−0.59×(D.P.)$^2$−11.7×(D.P.)+120,

C=exp(T/100)/[Si],

[Si] is a concentration of Si in mass %, [Mn] is a concentration of Mn in mass %, D.P. is the dew point of the atmosphere in the soaking zone in ° C. where −50° C.<D.P.<−5° C., and T is the delivery temperature of the heating zone for the steel strip in ° C. where 400° C.<T<850° C.

[2] The method of producing a high-strength hot-dip galvanized steel sheet according to [1], wherein the heating zone includes a direct fired furnace divided into an earlier stage and a latter stage, an air ratio of an atmosphere in the earlier stage is 1.0 or more and less than 1.3, and an air ratio of an atmosphere in the latter stage is 0.7 or more and less than 1.0.

[3] The method of producing a high-strength hot-dip galvanized steel sheet according to [1] or [2], wherein in the soaking zone, the steel strip is subjected to reduction annealing in a temperature range of 700° C. or more and 900° C. or less for 10 sec or more and 300 sec or less, with a hydrogen concentration of the atmosphere in the soaking zone being 5 vol % or more and 30 vol % or less.

[4] The method of producing a high-strength hot-dip galvanized steel sheet according to any one of [1] to [3], further comprising subjecting, after the hot-dip galvanizing, the high-strength hot-dip galvanized steel sheet to alloying treatment of heating in a temperature range of 460° C. or more and 600° C. or less for 10 sec or more and 60 sec or less.

[5] The method of producing a high-strength hot-dip galvanized steel sheet according to any one of [1] to [4], wherein the chemical composition further contains, in mass %, C: 0.8% or less, P: 0.1% or less, S: 0.03% or less, Al: 0.1% or less, B: 0.005% or less, and Ti: 0.2% or less, with a balance consisting of Fe and inevitable impurities.

[6] The method of producing a high-strength hot-dip galvanized steel sheet according to any one of [1] to [5], wherein the chemical composition further contains, in mass %, one or more selected from the group consisting of N: 0.010% or less, Cr: 1.0% or less, Cu: 1.0% or less, Ni: 1.0% or less, Mo: 1.0% or less, Nb: 0.20% or less, V: 0.5% or less, Sb: 0.200% or less, Ta: 0.1 or less, W: 0.5% or less, Zr: 0.1% or less, Sn: 0.20% or less, Ca: 0.005% or less, Mg: 0.005% or less, and REM: 0.005% or less.

[7] The method of producing a high-strength hot-dip galvanized steel sheet according to any one of [1] to [6], wherein D.P. and T are controlled based on a concentration of Si and a concentration of Mn of each of a plurality of types of steel strips having different chemical compositions each within a range of the chemical composition so that all of the steel strips will satisfy the Formula (1).

[8] The method of producing a high-strength hot-dip galvanized steel sheet according to any one of [1] to [7], wherein D.P. is −30° C. or less.

Advantageous Effect

It is thus possible to obtain a high-strength hot-dip galvanized steel sheet having excellent surface appearance even in the case where a steel strip containing Mn at a predetermined ratio or more to Si is subjected to hot-dip galvanizing treatment.

DETAILED DESCRIPTION

Figure 1:
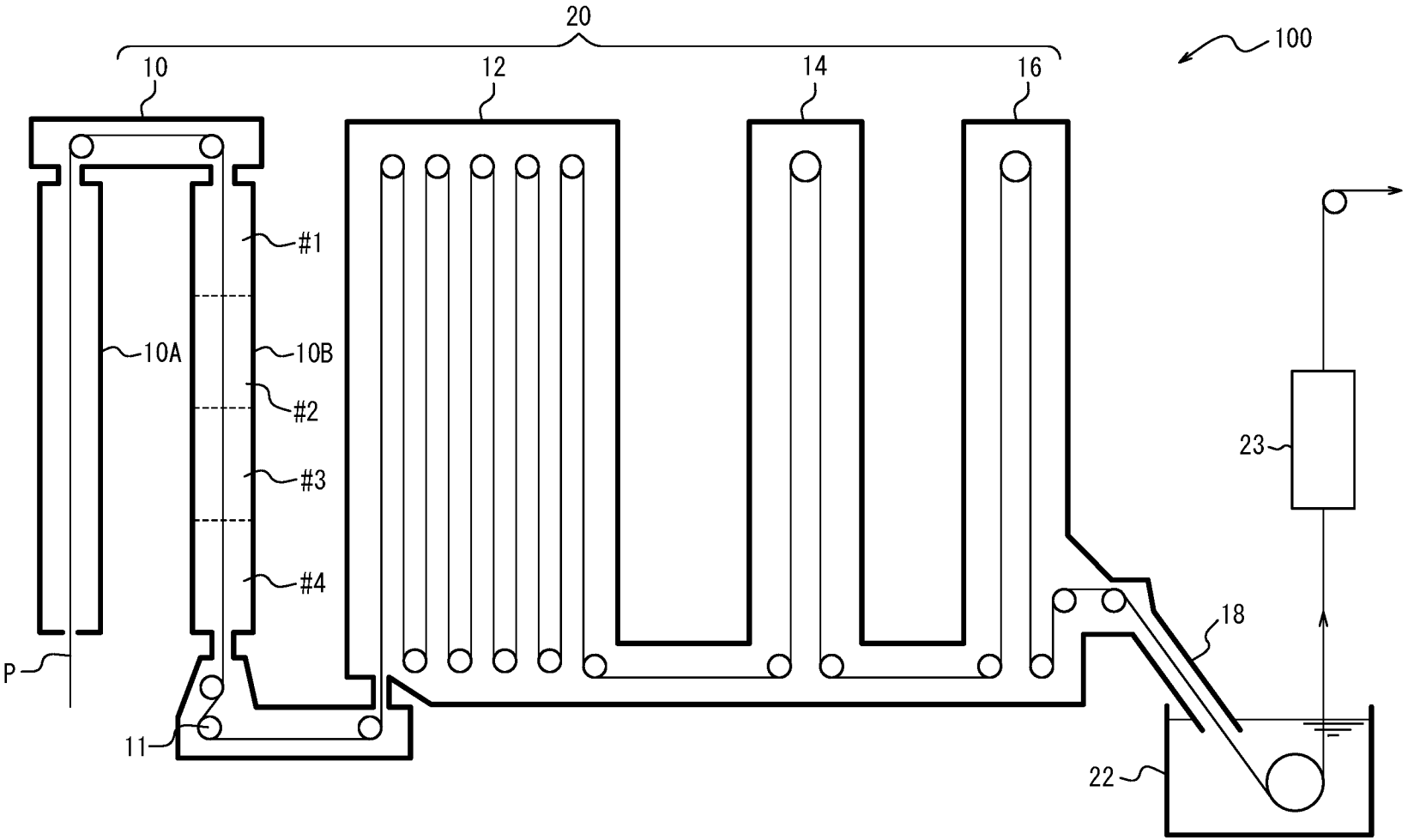
FIG. 1 is a schematic diagram illustrating the structure of a continuous hot-dip galvanizing apparatus.

One of the disclosed embodiments will be described in detail below. In the following description, the unit of the content of each element in the chemical composition of steel and the unit of the content of each element in the chemical composition of a coating layer are "mass %", which is simply expressed as "%" unless otherwise noted. The unit of gas concentration is "vol %", which is simply expressed as "%" unless otherwise noted.

Herein, "high strength" of a steel sheet means that the tensile strength of the steel sheet is 340 MPa or more.

A method of producing a high-strength hot-dip galvanized steel sheet is a method of producing a high-strength hot-dip galvanized steel sheet using a continuous hot-dip galvanizing apparatus including an annealing furnace in which a heating zone, a soaking zone, and a cooling zone are arranged side by side in the stated order and a hot-dip galvanizing line located downstream of the cooling zone, the method comprising: subjecting a steel strip to annealing, by conveying the steel strip in the annealing furnace in an order of the heating zone, the soaking zone, and the cooling zone; and subjecting the steel strip discharged from the cooling zone to hot-dip galvanizing using the hot-dip galvanizing line, to obtain a high-strength hot-dip galvanized steel sheet, wherein the steel strip has a chemical composition containing, in mass %, Mn: 1.7% or more and 3.5% or less and Si: 0.2% or more and 1.05% or less and satisfying [Si]/[Mn] ≤0.30, and the chemical composition, a dew point of an atmosphere in the soaking zone, and a delivery temperature of the heating zone satisfy the following Formula (1):

$$A\times 50+B-C/30<140 \quad (1)$$

where $A=[Mn]-[Si]\times 4$, $B=-0.0068\times(D.P.)^3-0.59\times(D.P.)^2-11.7\times(D.P.)+120$, $C=\exp(T/100)/[Si]$,

[Si] is a concentration of Si in mass %, [Mn] is a concentration of Mn in mass %, D.P. is the dew point of the atmosphere in the soaking zone in ° C. where −50° C.<D.P.<−5° C., and T is the delivery temperature of the heating zone for the steel strip in ° C. where 400° C.<T<850° C.

First, the chemical composition of the steel strip as a base steel sheet will be described below.

Mn: 1.7% or more and 3.5% or Less

Mn is an element effective in strengthening the steel, as mentioned above. If the Mn content is less than 1.7%, Mn single oxide (i.e. oxide of Mn alone) does not form excessively and there is no need to apply the production method according to the present disclosure, as described later. The Mn content is therefore 1.7% or more. If the Mn content is more than 3.5%, Mn single oxide forms excessively, and favorable surface appearance cannot be achieved even when the steel strip delivery temperature of the heating zone and the dew point of the soaking zone are appropriately controlled based on Formula (1). The Mn content is therefore 1.7% or more and 3.5% or less. The Mn content is preferably 2.0% or more, and more preferably 2.3% or more. The Mn content is preferably 3.3% or less, and more preferably 3.0% or less.

Si: 0.2% or more and 1.05% or Less

Si is an element effective in strengthening the steel and achieving favorable material properties. If the Si content is less than 0.2%, another expensive alloying element needs to be added in order to achieve high strength, which is economically undesirable. If the Si content is less than 0.2%, there is no need to apply the production method according to the present disclosure. The reason for this is not clear, but can be presumed as follows: Since a sufficient amount of iron oxide is generated by the below-described oxidation treatment, the oxidation of Si and Mn in the steel sheet outermost layer during reduction annealing is reduced, and the surface appearance is not significantly affected. The upper limit of the Si content is 1.05% to satisfy $[Si]/[Mn]\leq 0.30$, as described later. The Si content is therefore 0.3% or more and 1.05% or less. The Si content is preferably 0.3% or more, and more preferably 0.4% or more. The Si content is preferably 0.9% or less, and more preferably 0.7% or less.

$[Si]/[Mn]\leq 0.30$

Here, [Si] is the concentration of Si (mass %), and [Mn] is the concentration of Mn (mass %).

If $[Si]/[Mn]>0.30$, the influence of Si—Mn surface oxide (complex oxide of Si and Mn) on the surface appearance is dominant, and there is no need to control the steel strip delivery temperature of the heating zone and the dew point of the atmosphere in the soaking zone based on Formula (1), as described later. If $[Si]/[Mn]\leq 0.30$, the influence of Mn single oxide on the surface appearance is dominant, and a high-strength hot-dip galvanized steel sheet having excellent surface appearance can be obtained by controlling the steel strip delivery temperature of the heating zone and the dew point of the atmosphere in the soaking zone based on Formula (1). [Si]/[Mn] is therefore 0.30 or less. [Si]/[Mn] is preferably 0.25 or less.

The chemical composition may optionally further contain the following components.

C: 0.8% or Less

C causes the formation of martensite and the like as steel microstructure, and thus improves workability. In the case of adding C, the C content is preferably 0.8% or less and more preferably 0.30% or less, to achieve favorable weldability. No lower limit is placed on the C content, but the C content is preferably 0.03% or more and more preferably 0.05% or more to achieve favorable workability.

P: 0.1% or Less (not Including 0%)

By reducing the P content, a decrease in weldability can be prevented. Moreover, the segregation of P to grain boundaries can be prevented to thus prevent degradation in ductility, bendability, and toughness. To suppress ferrite transformation and obtain fine crystal grains, the P content is preferably 0.1% or less. No lower limit is placed on the P content, and the P content may be more than 0% under manufacturing constraints, and may be 0.001% or more.

S: 0.03% or Less (not Including 0%)

The S content is preferably 0.03% or less, and more preferably 0.02% or less. By reducing the S content, a decrease in weldability can be prevented, and also a decrease in hot ductility can be prevented to suppress hot cracking, with it being possible to significantly improve the surface characteristics. Moreover, by reducing the S content, it is possible to prevent decreases in the ductility, bendability, and stretch flangeability of the steel sheet due to S forming coarse sulfide as an impurity element. These problems are noticeable when the S content is more than 0.030%. Hence, it is desirable to reduce the S content as much as possible. No lower limit is placed on the S content, and the S content may be more than 0% under manufacturing constraints, and may be 0.0001% or more.

Al: 0.1% or Less

Al is most easily oxidizable thermodynamically, and has the effect of, by oxidizing before Si and Mn, suppressing the oxidation of Si and Mn in the steel sheet outermost layer and facilitating the oxidation of Si and Mn inside the steel sheet. This effect is achieved if the Al content is 0.01% or more. If the Al content is more than 0.1%, the costs increase. Accordingly, in the case of adding Al, the Al content is preferably 0.1% or less. No lower limit is placed on the Al content, and the Al content may be more than 0%, and may be 0.001% or more.

B: 0.005% or Less

B is an element effective in improving the hardenability of the steel. The B content is preferably 0.0003% or more and more preferably 0.0005% or more, to improve the hardenability. The B content is preferably 0.005% or less. If the B content is 0.005% or less, the oxidation of Si in the steel sheet outermost layer can be suppressed to achieve favorable coating adhesion property.

Ti: 0.2% or Less

In the case of adding Ti, the Ti content is preferably 0.2% or less, and more preferably 0.05% or less. If the Ti content is 0.2% or less, favorable coating adhesion property can be achieved. No lower limit is placed on the Ti content, but the Ti content is preferably 0.005% or more in order to achieve the strength adjusting effect.

The chemical composition may optionally further contain one or more selected from the group consisting of N: 0.010% or less, Cr: 1.0% or less, Cu: 1.0% or less, Ni: 1.0% or less, Mo: 1.0% or less, Nb: 0.20% or less, V: 0.5 or less, Sb: 0.200% or less, Ta: 0.1% or less, W: 0.5% or less, Zr: 0.1% or less, Sn: 0.20% or less, Ca: 0.005% or less, Mg: 0.005% or less, and REM: 0.005% or less.

N: 0.010% or Less (not Including 0%)

The N content is preferably 0.010% or less. If the N content is 0.010 or less, it is possible to prevent the effect of strengthening the steel sheet by the addition of Ti, Nb, and V from being ruined as a result of N forming coarse nitride with Ti, Nb, and Vat high temperature. Moreover, if the N content is 0.010% or less, a decrease in toughness can be prevented. Further, if the N content is 0.010% or less, slab cracking and surface defects during hot rolling can be prevented. The N content is more preferably 0.005% or less, further preferably 0.003% or less, and most preferably 0.002% or less. No lower limit is placed on the N content, and the N content may be more than 0% under manufacturing constraints, and may be 0.0005% or more.

Cr: 1.0% or Less

The Cr content is preferably 0.005% or more. If the Cr content is 0.005% or more, the hardenability can be improved, and the balance between the strength and the ductility can be improved. In the case of adding Cr, the Cr content is preferably 1.0% or less from the viewpoint of preventing a cost increase.

Cu: 1.0% or Less

The Cu content is preferably 0.005% or more. If the Cu content is 0.005% or more, the formation of retained γ phase can be facilitated, and also the coating adhesion property can be improved in the case of combined addition with Ni and Mo. In the case of adding Cu, the Cu content is preferably 1.0% or less from the viewpoint of preventing a cost increase.

Ni: 1.0% or Less

The Ni content is preferably 0.005% or more. If the Ni content is 0.005% or more, the formation of retained γ phase can be facilitated, and also the coating adhesion property can be improved in the case of combined addition with Cu and Mo. In the case of adding Ni, the Ni content is preferably 1.0% or less from the viewpoint of preventing a cost increase.

Mo: 1.0% or Less

The Mo content is preferably 0.005% or more. If the Mo content is 0.005% or more, the strength adjusting effect can be achieved, and also the coating adhesion property can be improved in the case of combined addition with Nb, Ni, and Cu. In the case of adding Mo, the Mo content is preferably 0.05% or more and 1.0% or less from the viewpoint of preventing a cost increase.

Nb: 0.20% or Less

If the Nb content is 0.005% or more, the strength improving effect can be achieved. In the case of adding Nb, the Nb content is preferably 0.20% or less from the viewpoint of preventing a cost increase.

V: 0.5% or Less

If the V content is 0.005% or more, the strength improving effect can be achieved. In the case of adding V, the V content is preferably 0.5% or less from the viewpoint of preventing a cost increase.

Sb: 0.200% or Less

Sb may be added from the viewpoint of suppressing the nitridization and oxidation of the steel sheet surface and the decarburization of a region of several tens of microns of the steel sheet surface caused by oxidation. By suppressing the nitridization and oxidation of the steel sheet surface, Sb can prevent a decrease in the amount of martensite formed at the steel sheet surface, and improve the fatigue resistance and surface quality of the steel sheet. To achieve this effect, the Sb content is preferably 0.001% or more. To achieve favorable toughness, the Sb content is preferably 0.200% or less.

Ta: 0.1% or Less

If the Ta content is 0.001% or more, the strength improving effect can be achieved. In the case of adding Ta, the Ta content is preferably 0.1% or less from the viewpoint of preventing a cost increase.

W: 0.5% or Less

If the W content is 0.005% or more, the strength improving effect can be achieved. In the case of adding W, the W content is preferably 0.5% or less from the viewpoint of preventing a cost increase.

Zr: 0.1% or Less

If the Zr content is 0.0005% or more, the strength improving effect can be achieved. In the case of adding Zr, the Zr content is preferably 0.1% or less from the viewpoint of preventing a cost increase.

Sn: 0.20% or Less

Sn is an element effective in suppressing denitrification, deboronization, and the like and suppressing a decrease in the strength of the steel. To achieve this effect, the Sn content is preferably 0.002% or more. To achieve favorable impact resistance, the Sn content is preferably 0.20% or less.

Ca: 0.005% or Less

If the Ca content is 0.0005% or more, the sulfide morphology can be controlled and the ductility and the toughness can be improved. The Ca content is preferably 0.005% or less, from the viewpoint of achieving favorable ductility.

Mg: 0.005% or Less

If the Mg content is 0.0005% or more, the sulfide morphology can be controlled and the ductility and the toughness can be improved. In the case of adding Mg, the Mg content is preferably 0.005% or less from the viewpoint of preventing a cost increase.

REM: 0.005% or Less

If the REM content is 0.0005% or more, the sulfide morphology can be controlled and the ductility and the toughness can be improved. In the case of adding REM, the REM content is preferably 0.005% or less from the viewpoint of achieving favorable toughness.

The balance other than the above may consist of Fe and inevitable impurities.

A steel strip having the foregoing chemical composition is subjected to hot-dip galvanizing treatment by the below-described method of producing a high-strength hot-dip galvanized steel sheet and optionally further subjected to alloying treatment, to obtain a high-strength hot-dip galvanized steel sheet. The method of obtaining the steel strip is not limited. The steel strip may be obtained by hot rolling, pickling, and then cold rolling a steel slab having the foregoing chemical composition by a known method. The thickness of the steel strip is not limited, and is typically 0.3 mm or more and 2.8 mm or less.

The method of producing a high-strength hot-dip galvanized steel sheet will be described below. The method of producing a high-strength hot-dip galvanized steel sheet is a method of producing a high-strength hot-dip galvanized steel sheet using a continuous hot-dip galvanizing apparatus including an annealing furnace in which a heating zone, a soaking zone, and a cooling zone are arranged side by side in the stated order and a hot-dip galvanizing line located downstream of the cooling zone, the method comprising: subjecting a steel strip to annealing, by conveying the steel strip in the annealing furnace in an order of the heating zone, the soaking zone, and the cooling zone; and subjecting the steel strip discharged from the cooling zone to hot-dip galvanizing using the hot-dip galvanizing line, to obtain a high-strength hot-dip galvanized steel sheet, wherein the steel strip has a chemical composition containing, in mass %, Mn: 1.7% or more and 3.5% or less and Si: 0.2% or more and 1.05% or less and satisfying [Si]/[Mn]≤0.30, and the chemical composition, a dew point of an atmosphere in the soaking zone, and a delivery temperature of the heating zone satisfy the following Formula (1):

$$A\times 50+B-C/30<140 \quad (1)$$

where A=[Mn]−[Si]×4,

B=−0.0068×(D.P.)$^3$−0.59×(D.P.)$^2$−11.7×(D.P.)+120,

C=exp(T/100)/[Si],

[Si] is a concentration of Si in mass %, [Mn] is a concentration of Mn in mass %, D.P. is the dew point of the atmosphere in the soaking zone in ° C. where −50° C.<D.P.<−5° C., and T is the delivery temperature of the heating zone for the steel strip in ° C. where 400° C.<T<850° C.

First, a steel strip (thin steel sheet) having the foregoing chemical composition is obtained by a known method. In one example, a steel slab is heated, and then hot-rolled to obtain a hot-rolled sheet. The hot-rolled sheet is then pickled, and then cold-rolled once or cold-rolled twice or more with intermediate annealing therebetween, to obtain a steel strip as a base steel sheet.

Following this, the steel strip is subjected to annealing using a continuous hot-dip galvanizing apparatus. The structure of the continuous hot-dip galvanizing apparatus according to the present disclosure will be described below, with reference to FIG. 1. A continuous hot-dip galvanizing apparatus 100 includes: an annealing furnace 20 in which a heating zone 10, a soaking zone 12, and cooling zones 14 and 16 are arranged side by side in this order; a hot-dip galvanizing bath 22 as a hot-dip galvanizing line located downstream of the cooling zone 16; and an alloying line 23 located downstream of the hot-dip galvanizing bath 22. In this embodiment, the heating zone 10 includes a first heating zone 10A and a second heating zone 10B. A snout 18 connected to the cooling zone 16 has its tip immersed in the hot-dip galvanizing bath 22, and connects the annealing furnace 20 and the hot-dip galvanizing bath 22.

A steel strip P is introduced into the first heating zone 10A from a steel strip introduction port in the lower part of the first heating zone 10A, and then introduced into the second heating zone 10B connected to the first heating zone 10A. One or more hearth rolls are located in the upper part and the lower part of each of the zones 10, 12, 14, and 16. In the case where the steel strip P is folded back by 180 degrees at at least one hearth roll in a predetermined zone of the annealing furnace 20, the steel strip P is conveyed up and down a plurality of times in the predetermined zone, thus forming a plurality of passes. While FIG. 1 illustrates an example of having 10 passes in the soaking zone 12, 2 passes in the first cooling zone 14, and 2 passes in the second cooling zone 16, the numbers of passes are not limited to such, and may be set as appropriate depending on the treatment conditions. At some of the hearth rolls, the steel strip P is not folded back but changed in direction at the right angle to move to the next zone. Thus, the steel strip P can be annealed as a result of being conveyed in the annealing furnace 20 in the order of the heating zone 10, the soaking zone 12, and the cooling zones 14 and 16.

First, oxidation treatment performed on the steel strip P in the heating zone 10 will be described below. As mentioned above, adding Si, Mn, and the like to the steel is effective in strengthening the steel sheet. In the steel strip P to which these elements have been added, however, oxide of Si and Mn forms in the steel sheet outermost layer during the annealing performed before the hot-dip galvanizing treatment, which causes degradation in surface appearance.

In view of this, we conducted study and learned the following: By adjusting the conditions of the annealing performed before the hot-dip galvanizing treatment to suppress the oxidation of Si and Mn in the steel sheet outermost layer, the surface appearance can be improved, and also the reactivity between the coating and the steel strip P can be enhanced to improve the coating adhesion property.

An effective way of suppressing the oxidation of Si and Mn in the steel sheet outermost layer is to perform oxidation treatment in the heating zone 10 and then perform reduction annealing and hot dip coating and optionally alloying treatment. Moreover, it is important to suppress the oxidation of Si and Mn in the steel sheet outermost layer by appropriately controlling the steel strip delivery temperature of the heating zone 10 used for the oxidation treatment and the dew point of the atmosphere in the soaking zone 12 used for the reduction annealing.

However, if the steel strip P on which a certain amount or more of iron oxide has been formed as a result of the oxidation treatment is subjected to the reduction annealing, a pick-up defect (i.e. some kind of reactant is formed on a hearth roll and transferred to the steel sheet to cause a pressing flaw) is likely to occur. It is therefore important to divide the second heating zone 10B used for the oxidation treatment into two zones, i.e. an earlier stage on the upstream side in the steel sheet moving direction and a latter stage on the downstream side in the steel sheet moving direction, and control the air ratio of the atmosphere in each of the earlier stage and the latter stage. Oxidation treatment (earlier-stage treatment) in the earlier stage of the second heating zone 10B and oxidation treatment (latter-stage treatment) in the latter stage of the second heating zone 10B will be described below.

[Earlier-Stage Treatment]

In the earlier stage of the second heating zone 10B, oxidation treatment is actively performed in order to suppress the oxidation of Si and Mn in the steel sheet outermost layer and cause the formation of iron oxide. To form a sufficient amount of iron oxide and eventually achieve aesthetic surface appearance, the air ratio of the atmosphere in the earlier stage of the second heating zone 10B is preferably 1.0 or more, and preferably less than 1.3. The air ratio of the atmosphere in the earlier stage of the second heating zone 10B is more preferably 1.1 or more. The air ratio of the atmosphere in the earlier stage of the second heating zone 10B is more preferably 1.2 or less. The heating temperature in the earlier-stage treatment is preferably 400° C. or more, to facilitate the oxidation of iron. The heating temperature in the earlier-stage treatment is preferably 850° C. or less. If the heating temperature in the earlier-stage treatment is 850° C. or less, the amount of iron oxide formed can be limited to a suitable range, with it being possible to prevent the occurrence of a pick-up defect in the next process.

[Latter-Stage Treatment]

To prevent a pick-up defect and achieve aesthetic surface appearance without a pressing flaw and the like, it is important to reduce the surface layer of iron oxide that has been oxidized. For such reducing treatment, the air ratio of the atmosphere in the latter stage of the second heating zone 10B is preferably 0.7 or more, and preferably less than 1.0. By decreasing the air ratio of the atmosphere in the latter stage of the second heating zone 10B, the surface layer of iron oxide is partially reduced. This prevents direct contact between the rolls in the soaking zone 12 and the iron oxide in the next process of reduction annealing, so that a pick-up defect can be prevented. The heating temperature in the latter-stage treatment is preferably 600° C. or more. If the heating temperature in the latter-stage treatment is 600° C. or more, the steel sheet outermost layer can be reduced favorably. The heating temperature in the latter-stage treatment is preferably 850° C. or less. If the heating temperature is 850° C. or less, the heating costs can be reduced.

To regulate the air ratio of the atmosphere in the earlier-stage treatment and the air ratio of the atmosphere in the latter-stage treatment independently of each other as described above, the second heating zone 10B needs to be composed of at least two zones. In the case where the second heating zone 10B is composed of two zones, the atmospheres of the two zones are controlled in the above-described manner. In the case where the second heating zone 10B is composed of three or more zones, the atmospheres of any successive zones are equally controlled as one zone. The earlier-stage treatment and the latter-stage treatment may be performed in separate oxidation furnaces. From the viewpoint of industrial productivity and implementing the presently disclosed techniques by improving an existing production line, however, it is preferable to partition the same furnace into two or more zones and perform atmosphere control in each of the zones. In this embodiment, the second heating zone 10B is divided into four groups (#1 to #4), and the three groups (#1 to #3) on the upstream side in the steel sheet moving direction are set as the earlier stage and the last zone (#4) is set as the latter stage, as illustrated in FIG. 1.

The second heating zone 10B may be any of a direct fired furnace (DFF) and a non-oxidizing furnace (NOF). The second heating zone 10B is preferably a DFF. The DFF is often used in continuous hot-dip galvanizing lines, and eases the control of the air ratio in each zone. The use of the DFF is also advantageous in that the steel strip can be heated quickly (i.e. the heating rate is high) and therefore the furnace length of the heating zone 10 can be shortened and the line speed can be increased. Hence, the use of the DFF is preferable from the viewpoint of production efficiency. For example, the DFF mixes fuel such as cokes oven gas (COG) which is byproduct gas in steelworks and air to cause combustion and heat the steel sheet. If the ratio of air to fuel is increased, unburnt oxygen remains in the flame. Such oxygen can promote the oxidation of the steel sheet.

A plurality of burners are distributed on the inner wall of the second heating zone 10B so as to face the steel strip P, although not illustrated in FIG. 1. Preferably, the plurality of burners are separated into a plurality of groups, and the combustion rate and the air ratio in each group are controllable independently. In this embodiment, the heating burners in the second heating zone 10B are divided into four groups (#1 to #4), and the three groups (#1 to #3) on the upstream side in the steel sheet moving direction are set as an oxidizing burner used for the earlier-stage treatment and the last zone (#4) is set as a reducing burner used for the latter-stage treatment, where the air ratio of the oxidizing burner and the air ratio of the reducing burner are separately controllable. The air ratio of the atmosphere in each of the earlier stage and the latter stage of the second heating zone 10B is the value obtained by dividing the amount of air actually introduced into each burner by the amount of air necessary to completely combust fuel gas.

The temperature T on the steel strip delivery side of the heating zone 10, i.e. on the steel strip delivery side of the second heating zone 10B, is controlled to satisfy the following Formula (1) (described later):

$$A\times 50+B-C/30<140 \quad (1)$$

where $A=[Mn]-[Si]\times 4$, $B=-0.0068\times(D.P.)^3-0.59\times(D.P.)^2-11.7\times(D.P.)+120$, $C=\exp(T/100)/[Si]$,

[Si] is the concentration of Si (mass %), [Mn] is the concentration of Mn (mass %), D.P. is the dew point of the atmosphere in the soaking zone (° C.) (where −50° C.<D.P.<−5° C.), and T is the steel strip delivery temperature of the heating zone (° C.) (where 400° C.<T<850° C.).

The steel strip delivery temperature T of the heating zone 10 is measured using a radiation thermometer. As the method of measurement by the radiation thermometer, a multipath reflection-based method which is not affected by the steel sheet surface is used. The radiation thermometer is installed immediately downstream of the second heating zone 10B (near the second hearth roll 11 from the steel strip delivery side of the second heating zone 10B in FIG. 1). The steel strip delivery temperature T of the heating zone 10 is more than 400° C. and less than 850° C. If the steel strip delivery temperature T is more than 400° C., surface concentration of excess Mn can be suppressed and favorable surface appearance can be achieved. If the steel strip delivery temperature T is 850° C. or more, there is a possibility that more iron oxide than necessary is formed in the first heating zone and the iron oxide is not sufficiently reduced in the second heating zone, which causes a pick-up defect. The steel strip delivery temperature T of the heating zone 10 is more preferably 750° C. or less, and further preferably 700° C. or less.

Next, reduction annealing performed in the soaking zone 12 following the oxidation treatment will be described below. In the reduction annealing, the iron oxide formed on the steel sheet surface as a result of the oxidation treatment is reduced, and also oxygen supplied from the iron oxide causes Si and Mn to form internal oxide inside the steel strip. Consequently, a reduced iron layer in which the iron oxide has been reduced is formed in the steel sheet outermost layer, and Si and Mn remain inside the steel strip as internal oxide. Thus, the oxidation of Si and Mn in the steel sheet outermost layer can be suppressed, and a decrease in the wettability between the steel strip P and the coating can be prevented.

In the case where Mn is excessively added relative to Si, however, the surface appearance degrades even when the reduction annealing is performed, depending on the conditions of the reduction annealing. The cause of such degradation in surface appearance is considered as follows: While Si and Mn form internal oxide as complex oxide by the reduction annealing, excessively added Mn singly forms a large amount of oxide in the steel sheet outermost layer. In view of this, we conducted study to achieve favorable surface appearance, and consequently conceived the technique of suppressing the formation of oxide of Si and Mn in the steel sheet outermost layer and improving the surface appearance by controlling the steel strip delivery temperature of the heating zone 10 and the dew point of the atmosphere in the soaking zone 12.

A preliminary experiment that led to the discoveries of the presently disclosed techniques will be described below. In this preliminary experiment, a steel strip ([Si]/[Mn]=0.23; Example) having a chemical composition containing C: 0.09%, Si: 0.61%, Mn: 2.67%, Nb: 0.020%, V: 0.010%, Ti: 0.020%, Cu: 0.040%, Ni: 0.020%, Cr: 0.03%, Mo: 0.03%, and Al: 0.05% was subjected to oxidation treatment with the air ratio of the atmosphere in the earlier stage of the second heating zone 10B being 1.15, the air ratio of the atmosphere in the latter stage of the second heating zone 10B being 0.85, and the steel strip delivery temperature of the heating zone 10 being 650° C. or 700° C. The steel strip was then subjected to reduction annealing with the dew point in the soaking zone 12 being varied, with the $H_2$ concentration of the atmosphere in the soaking zone 12 being 15 vol % and the soaking temperature being 800° C. The steel strip was then subjected to hot-dip galvanizing treatment using a hot-dip galvanizing bath having a chemical composition of effective Al concentration in bath: 0.132 mass % with the balance consisting of Zn and inevitable impurities. After this, the steel strip was subjected to alloying treatment at 530° C. for 20 sec, to obtain a high-strength galvannealed steel sheet. As Comparative Example, a steel strip ([Si]/[Mn]=0.43) containing C: 0.12%, Si: 0.91%, and Mn: 2.11% was subjected to oxidation treatment at a steel strip delivery temperature of 700° C., and then subjected to reduction annealing with the dew point in the soaking zone 12 being varied and with the $H_2$ concentration of the atmosphere in the soaking zone 12 being 15 vol % and the soaking temperature being 800° C. The steel strip was then subjected to hot dip coating treatment, and then subjected to alloying treatment at 520° C. for 20 sec, to obtain a high-strength galvannealed steel sheet.

Figure 4:
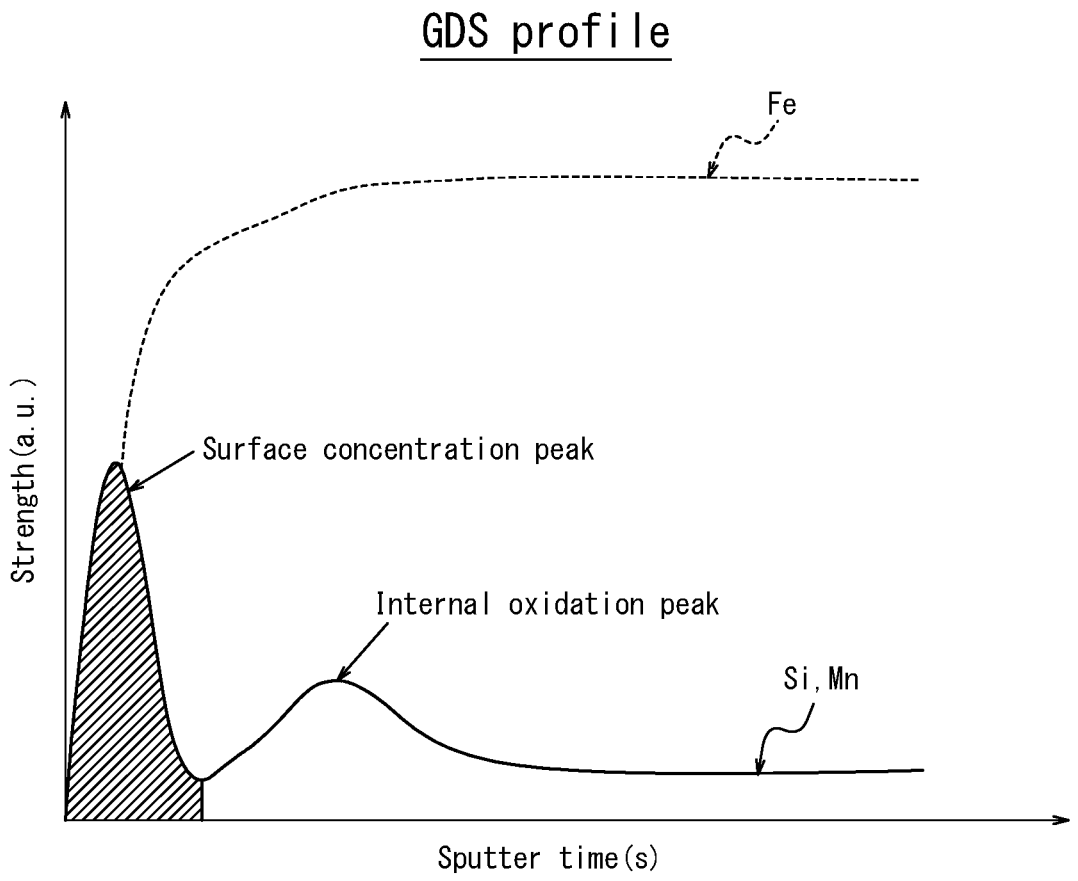
FIG. 4 is a diagram illustrating an example of a GDS profile of a steel sheet measured in the thickness direction by glow discharge emission spectroscopy.

Each steel sheet after reduction annealing obtained in this way was analyzed in the depth direction by glow discharge optical emission spectroscopy (GDS), to determine the concentration amounts of Si and Mn on the steel sheet surface. GDS-Profiler2 produced by HORIBA, Ltd. was used as a GDS apparatus, and the concentration amounts were determined under the conditions of high frequency, analysis diameter of ϕ4 mm, and output of 35 [W]. FIG. 4 illustrates an example of a GDS profile observed in the experiment. As illustrated in FIG. 4, the GDS profile of Si and Mn had a surface concentration peak caused by surface concentration and an internal oxidation peak caused by internal oxidation. From the GDS profile, the surface concentration amounts of Si and Mn were calculated for each steel sheet after reduction annealing. Here, the surface concentration amounts are each defined as the integrated value of the surface concentration peak in the GDS profile. FIGS. 2A to 2D illustrate the results.

Figure 2A:
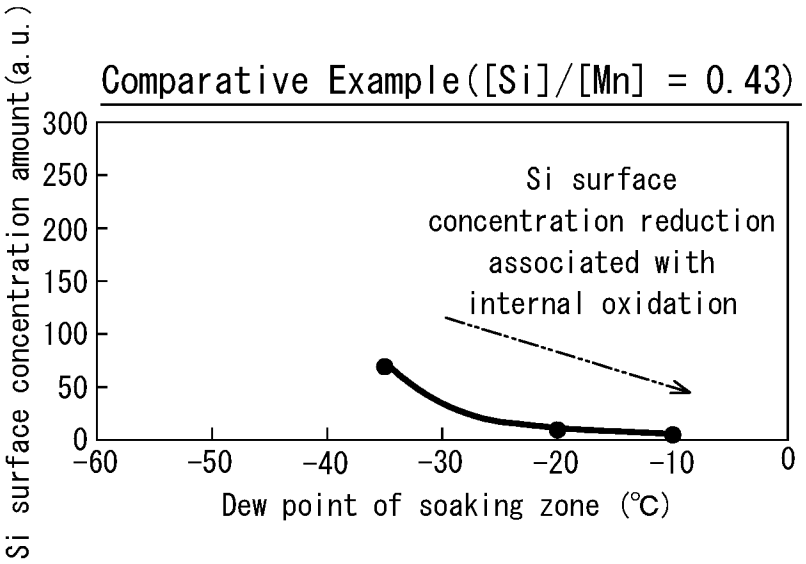
FIG. 2A is a graph illustrating the relationship between the dew point of the atmosphere in the soaking zone and the surface concentration amount of Si.
Figure 2B:
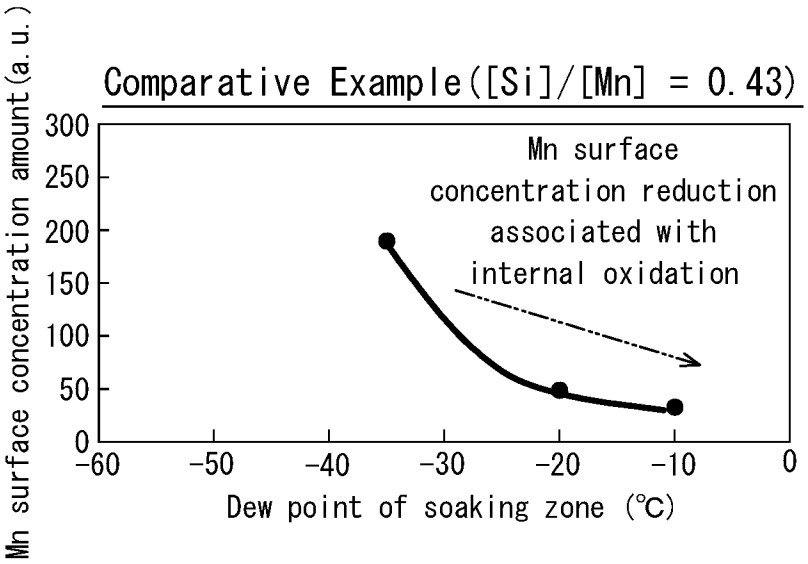
FIG. 2B is a graph illustrating the relationship between the dew point of the atmosphere in the soaking zone and the surface concentration amount of Mn.
Figure 2C:
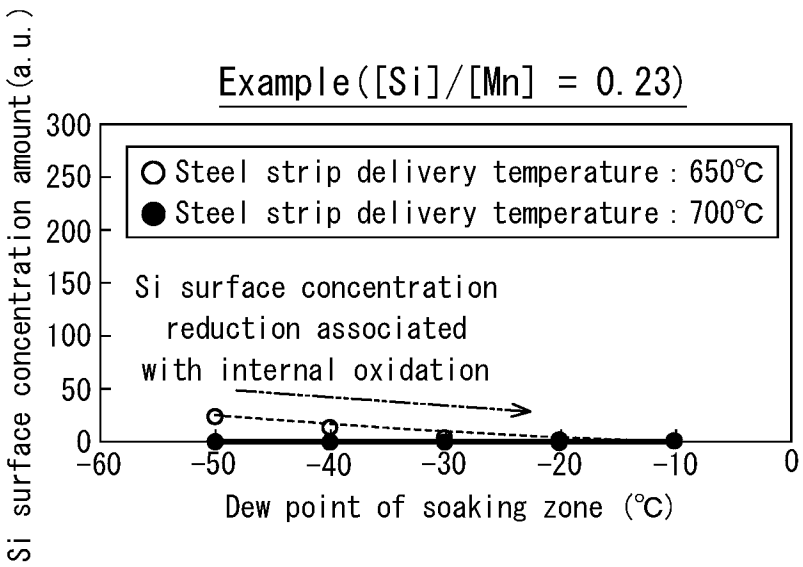
FIG. 2C is a graph illustrating the relationship between the dew point of the atmosphere in the soaking zone and the surface concentration amount of Si.
Figure 2D:
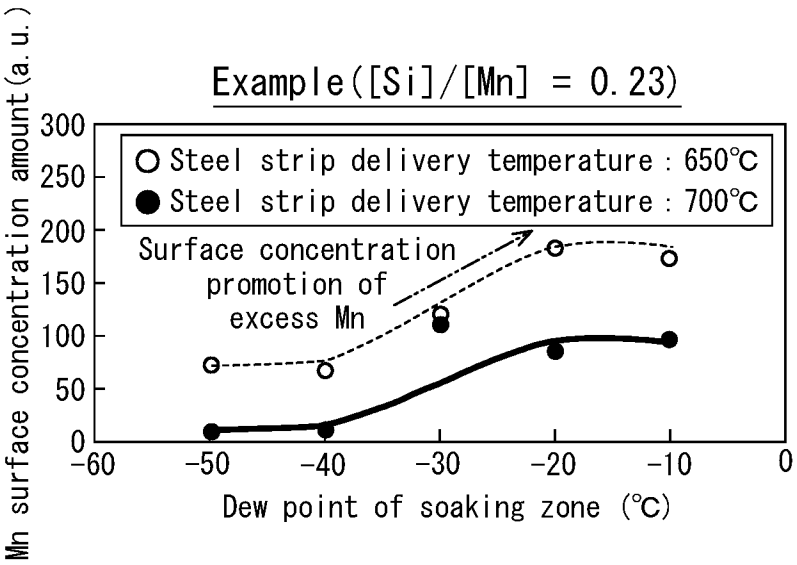
FIG. 2D is a graph illustrating the relationship between the dew point of the atmosphere in the soaking zone and the surface concentration amount of Mn.

FIG. 2A is a graph illustrating the relationship between the dew point of the atmosphere in the soaking zone and the surface concentration amount of Si in Comparative Example. FIG. 2B is a graph illustrating the relationship between the dew point of the atmosphere in the soaking zone and the surface concentration amount of Mn in Comparative Example. FIG. 2C is a graph illustrating the relationship between the dew point of the atmosphere in the soaking zone 12 and the surface concentration amount of Si in Example. FIG. 2D is a graph illustrating the relationship between the dew point of the atmosphere in the soaking zone 12 and the surface concentration amount of Mn in Example. Even when the [Si]/[Mn] ratio was different, the surface concentration behavior of Si was similar, as can be understood from comparison between FIGS. 2A and 2C. In detail, with an increase in the dew point of the atmosphere in the soaking zone 12, internal oxidation was facilitated and the surface concentration amount of Si decreased. On the other hand, the surface concentration behavior of Mn varied greatly depending on the [Si]/[Mn] ratio, as can be understood from comparison between FIGS. 2B and 2D. In Comparative Example with the [Si]/[Mn] ratio of 0.43, the surface concentration amount of Mn decreased with an increase in the dew point of the atmosphere in the soaking zone 12 as with the surface concentration amount of Si, as illustrated in FIG. 2B. In Example with the [Si]/[Mn] ratio of 0.23, in each of the case where the steel strip delivery temperature of the heating zone 10 was 650° C. and the case where the steel strip delivery temperature of the heating zone 10 was 700° C., the surface concentration amount of Mn increased with an increase in the dew point of the atmosphere in the soaking zone 12, and had a peak when the dew point of the atmosphere in the soaking zone 12 was around −20° C. (medium dew point), as illustrated in FIG. 2D.

Figure 3:
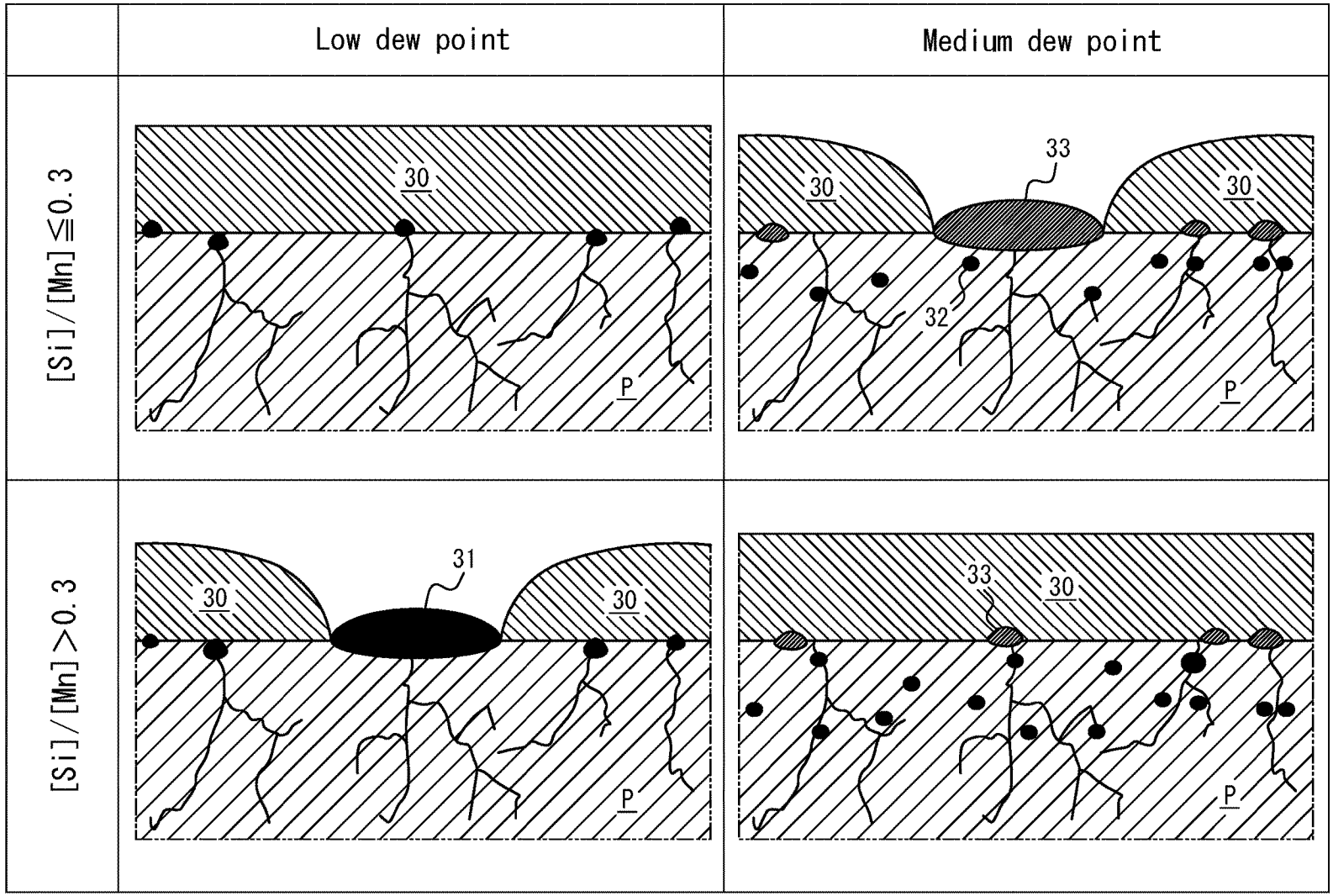
FIG. 3 is a diagram explaining the oxide precipitation forms on the surfaces of hot-dip galvanized steel sheets different in [Si]/[Mn] ratio at a low dew point and a medium dew point.

The results in FIGS. 2A to 2D will be explained below, with reference to FIG. 3. FIG. 3 is a diagram explaining the oxide precipitation forms in the case where the dew point of the atmosphere in the soaking zone 12 is a low dew point (−35° C.±5° C.) and in the case where the dew point of the atmosphere in the soaking zone 12 is a medium dew point (−15° C.±5° C.), for each of a steel type of [Si]/[Mn]≤0.30 and a steel type of [Si]/[Mn]>0.30. As illustrated in FIG. 3, in the steel type of [Si]/[Mn]>0.30, the Si content is high relative to the Mn content, and accordingly Si—Mn surface oxide forms easily and the influence of Si—Mn surface oxide on the surface appearance is dominant. At the low dew point, Si—Mn surface oxide 31 forms on the surface of the steel sheet P, which causes a non-coating defect in a coating layer 30. At the medium dew point, on the other hand, internal oxidation is facilitated and the formation of Si—Mn surface oxide 31 is suppressed, so that excellent surface appearance can be achieved. In the steel type of [Si]/[Mn] ≤0.30, the Si content is low relative to the Mn content, and accordingly the amount of Si—Mn complex oxide that precipitates into the steel sheet as Si—Mn internal oxide 32 is small, that is, excess Mn tends to concentrate on the surface and form Mn single oxide. Therefore, in the steel type of [Si]/[Mn]≤0.30, the influence of Mn surface oxide on the surface appearance is dominant. When the dew point of the atmosphere in the soaking zone 12 is low, Si and Mn form internal oxide as complex oxide. When the dew point of the atmosphere in the soaking zone 12 is medium, excess Mn forms a large amount of Mn single oxide 33 in the steel sheet outermost layer, causing degradation in surface appearance. As is clear from the result in FIG. 2D, the peak of the surface concentration amount of Mn decreases with an increase in the steel strip delivery temperature of the heating zone 10. Hence, we considered appropriately controlling the steel strip delivery temperature of the heating zone 10 and the dew point of the atmosphere in the soaking zone 12 to obtain a high-strength hot-dip galvanized steel sheet having excellent surface appearance even in the case where a steel strip of [Si]/[Mn]≤0.30 is subjected to hot-dip galvanizing treatment.

Figure 5A:
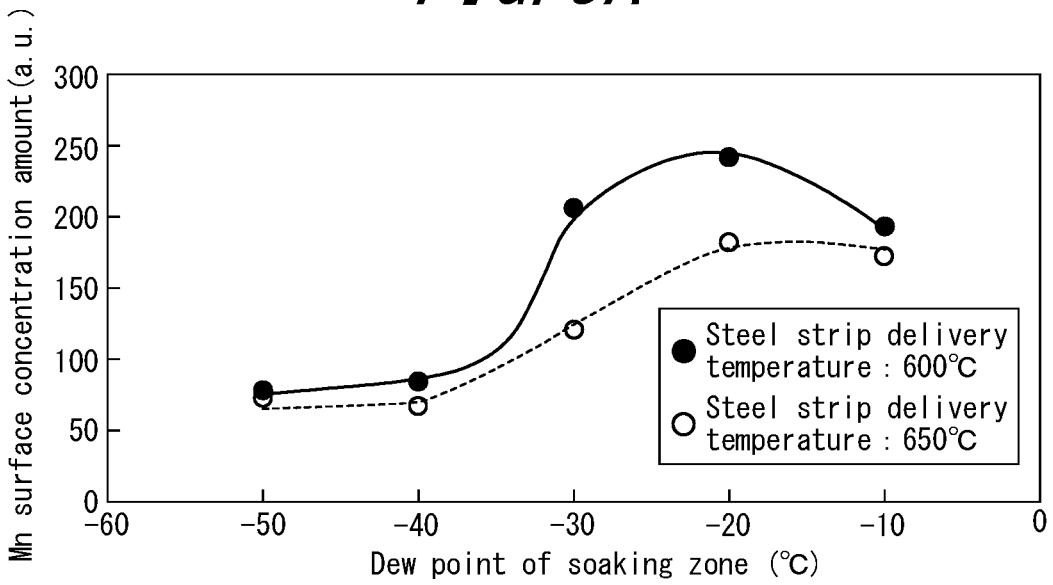
FIG. 5A is a diagram explaining analysis that led to Formula (1)
Figure 5B:
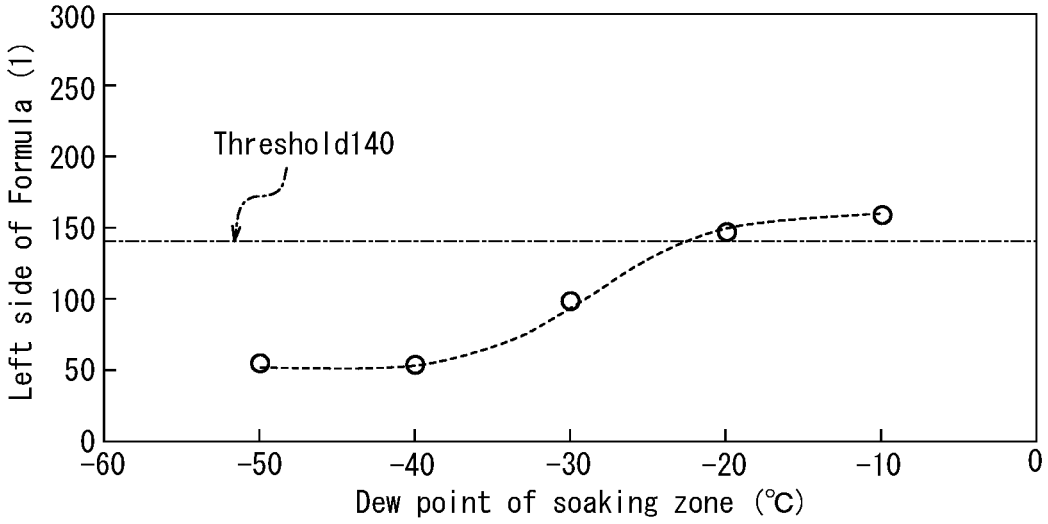
FIG. 5B is a diagram explaining analysis that led to Formula (1).

To study the appropriate steel strip delivery temperature of the heating zone 10 and dew point of the atmosphere in the soaking zone 12 depending on the chemical composition of the steel sheet, we derived the foregoing Formula (1) by multiple regression based on the data of Example in the preliminary experiment. An overview of analysis that lead to Formula (1) will be given below, with reference to FIGS. 5A and 5B. To examine a threshold for achieving favorable surface appearance, each high-strength hot-dip galvanized steel sheet was produced from the steel type of Example ([Si]/[Mn]=0.23) in the same way as in the foregoing preliminary experiment except that the steel strip delivery temperature of the heating zone 10 and the dew point of the atmosphere in the soaking zone 12 were changed. For each high-strength hot-dip galvanized steel sheet obtained, the relationship between each of the chemical composition, the steel strip delivery temperature of the heating zone 10, and the dew point of the atmosphere in the soaking zone 12 and Mn was subjected to multiple regression to yield the left side of Formula (1). Moreover, for each high-strength hot-dip galvanized steel sheet, the surface appearance was determined based on the same criteria as in the below-described examples. FIG. 5A illustrates an overview of the experimental data used for the multiple regression analysis. The Mn surface concentration amount tended to increase with an increase in the dew point, and the surface appearance degraded when the surface concentration amount was high. Next, the left side of Formula (1) and the surface appearance were compared to determine a threshold of the left side of Formula (1) for achieving favorable surface appearance. We consequently found out that favorable surface appearance can be achieved if the left side of Formula (1) is less than 140 as illustrated in FIG. 5B, and derived the following Formula (1):

$$A\times 50+B-C/30<140 \quad (1)$$

where $A=[Mn]-[Si]\times 4$, $B=-0.0068\times(D.P.)^3-0.59\times(D.P.)^2-11.7\times(D.P.)+120$, $C=\exp(T/100)/[Si]$,

[Si] is the concentration of Si (mass %), [Mn] is the concentration of Mn (mass %), D.P. is the dew point of the atmosphere in the soaking zone (° C.) (where −50° C.<D.P.<−5° C.), and T is the steel strip delivery temperature of the heating zone (° C.) (where 400° C.<T<850° C.).

We verified that, for various steel types, favorable surface appearance can be achieved if Formula (1) is satisfied, as indicated in the below-described examples.

The dew point D.P. of the atmosphere in the soaking zone 12 is controlled to satisfy Formula (1). D.P. is more than −50° C. and less than −5° C. When D.P. is lower, the oxidation of Si and Mn in the steel sheet outermost layer is suppressed to a greater degree, but the dehumidification costs increase. Accordingly, D.P. is more than −50° C. If D.P. is more than −5° C., the iron oxidation region is closer, and thus the surface appearance and the adhesion property are likely to degrade. Accordingly, D.P. is −5° C. or less. D.P. is preferably −30° C. or less. If D.P. is −30° C. or less, particularly favorable surface appearance can be achieved. D.P. is measured at a dew point measurement port provided in the soaking zone. The dew point measurement port is located 1 m or more away from each supply port for supplying humidified gas into the soaking zone and 1 m or more away from the position of the inner wall of the soaking zone 12 facing each supply port.

The method of controlling D.P. is not limited. Examples include a method of introducing heated steam into the soaking zone 12 and a method of introducing at least one of $N_2$ gas and $H_2$ gas humidified by bubbling or the like into the soaking zone 12. It is preferable to humidify the atmosphere in the soaking zone 12 by membrane exchange using a hollow fiber membrane to control D.P, for its especially favorable D.P. controllability.

The $H_2$ concentration of the atmosphere in the soaking zone 12 is preferably 5 vol % or more. The $H_2$ concentration of the atmosphere in the soaking zone 12 is preferably 30 vol % or less. If the $H_2$ concentration of the atmosphere in the soaking zone 12 is 5 vol % or more, the reduction of iron oxide can be further facilitated, and a pick-up defect can be further prevented.

The $H_2$ concentration of the atmosphere in the soaking zone 12 is more preferably 10 vol % or more. The $H_2$ concentration of the atmosphere in the soaking zone 12 is more preferably 20 vol % or less. Limiting the $H_2$ concentration of the atmosphere in the soaking zone 12 to 30 vol % or less has a cost advantage. The balance of the atmosphere in the soaking zone 12 other than $H_2$ preferably consists of $N_2$ and inevitable impurities.

The reduction annealing in the soaking zone 12 is preferably performed on the steel strip P at 700° C. or more. The reduction annealing in the soaking zone 12 is preferably performed on the steel strip P at 900° C. or less. If the reduction annealing is performed at 700° C. or more, the reduction of iron oxide can be further facilitated, and the mechanical properties of the steel sheet can be further improved. The reduction annealing is more preferably performed at 750° C. or more. If the reduction annealing is performed at 900° C. or less, the mechanical properties of the steel sheet can be improved. The reduction annealing is more preferably performed at 850° C. or less. The reduction annealing is preferably performed for 10 sec or more and preferably performed for 300 sec or less, from the viewpoint of further improving the mechanical properties of the steel sheet.

A high-strength hot-dip galvanized steel sheet produced by this method of producing a high-strength hot-dip galvanized steel sheet reliably has favorable surface appearance. Preferably, D.P. and T are controlled based on the Si concentration and the Mn concentration of each of a plurality of types of steel strips having different chemical compositions each within the range of the foregoing chemical composition so that all steel strips will satisfy the foregoing Formula (1). As a result of D.P. and T being controlled based on the Si concentration and the Mn concentration of each of a plurality of types of steel strips having various chemical compositions so that all steel strips will satisfy Formula (1), high-strength hot-dip galvanized steel sheets having favorable surface appearance can be stably obtained using not only steel strips having a specific chemical composition but steel strips having various chemical compositions.

A specific example of controlling D.P. and T based on the Si concentration and the Mn concentration of each of a plurality of types of steel strips having different chemical compositions each within the range of the foregoing chemical composition so that all steel strips will satisfy the foregoing Formula (1) is as follows: When the product specification of a steel strip to be continuously passed is changed and the Si concentration and the Mn concentration of the steel strip are changed, the changed Si concentration and Mn concentration may be substituted into Formula (1) to determine at least one of D.P. and T satisfying Formula (1). Since the control responsiveness of D.P. is poor, in the case of changing D.P., it is more preferable to feedforward-control the humidification in the furnace so as to satisfy the formula. Herein, "substituting into Formula (1)" is not limited to substituting into the exact same formula as Formula (1), and includes substituting into an inequality of a narrower range satisfying Formula (1). Moreover, "controlling D.P. and T so as to satisfy Formula (1) depending on the state in the annealing furnace" includes a mode in which at least one of D.P. and T is fixed as long as Formula (1) is satisfied. In this mode, the chemical composition of the steel strip may be changed so as to satisfy Formula (1). Specifically, while D.P. and T are fixed, the chemical composition of the steel strip to be passed next is selected so that the Si concentration and the Mn concentration will satisfy Formula (1). Although the above describes an example of control during operation in the method of producing a high-strength hot-dip galvanized steel sheet, it is also possible to perform a high-strength hot-dip galvanized steel sheet production condition determination method of determining, before the start of operation, whether the operation conditions satisfy Formula (1) and, in the case where the operation conditions do not satisfy Formula (1), changing at least one of the Si concentration, the Mn concentration, D.P., and T beforehand. Such a production condition determination method may be implemented as a process included in the method of producing a high-strength hot-dip galvanized steel sheet, or implemented as a separate process.

(Cooling Zone)

Following the reduction annealing in the soaking zone 12, the steel strip P is cooled in the cooling zones 14 and 16. The steel strip P is cooled to about 480° C. to 530° C. in the first cooling zone 14, and cooled to about 470° C. to 500° C. in the second cooling zone 16.

The steel strip P discharged from the cooling zone 16 is then subjected to hot-dip galvanizing using the hot-dip galvanizing bath 22, to obtain a high-strength hot-dip galvanized steel sheet.

The hot-dip galvanizing bath in which the hot-dip galvanizing treatment is performed preferably has a chemical composition having effective Al concentration in bath: 0.095 mass % or more and 0.175 mass % or less with the balance consisting of Zn and inevitable impurities. Herein, the "effective Al concentration in bath" is the value obtained by subtracting the Fe concentration in bath from the Al concentration in bath. If the effective Al concentration in bath is 0.095 mass % or more, it is possible to prevent the formation of γ phase which is a hard and brittle Fe—Zn alloy at the interface between the steel strip and the coating layer after alloying treatment, so that favorable coating adhesion property can be achieved. If the effective Al concentration in bath is 0.175 mass % or less, the alloying temperature can be reduced and favorable mechanical properties can be achieved. If the effective Al concentration in bath is 0.175 mass % or less, the amount of dross formed in the molten bath can be reduced, with it being possible to prevent surface defects caused by dross adhering to the steel sheet. Limiting the effective Al concentration in bath to 0.175 mass % or less also has a cost advantage. Hence, the effective Al concentration in bath is preferably 0.095 mass % or more. The effective Al concentration in bath is preferably 0.175 mass % or less. In the case where the high-strength hot-dip galvanized steel sheet is further subjected to alloying treatment, the effective Al concentration in bath is more preferably 0.115 mass % or less.

The other conditions in the hot-dip galvanizing are not limited. For example, the bath temperature of the hot-dip galvanizing bath may be in a typical range of 440° C. to 500° C., and the steel strip P whose sheet temperature is set to 440° C. to 550° C. may be introduced into the hot-dip galvanizing bath. The coating weight can be adjusted by gas wiping or the like.

After the steel strip P is subjected to the hot-dip galvanizing to obtain the high-strength hot-dip galvanized steel sheet, the high-strength hot-dip galvanized steel sheet may be further subjected to alloying treatment using the alloying line 23 to obtain a high-strength galvannealed steel sheet. By the alloying treatment, the hot-dip galvanized coating formed on the steel strip P is heated to be alloyed. The alloying treatment is preferably performed at a temperature of 460° C. or more. The alloying treatment is preferably performed at a temperature of 600° C. or less. If the alloying temperature is 460° C. or more, a steel sheet excellent in press formability can be provided without η phase remaining. If the alloying temperature is 600° C. or less, favorable coating adhesion property can be achieved. The alloying time is preferably 10 sec or more. The alloying time is preferably 60 sec or less.

EXAMPLES

First, steel slabs obtained by smelting steels having the chemical compositions in Table 1 were each subjected to hot rolling, pickling, and cold rolling to obtain a cold-rolled steel sheet of 1.4 mm in thickness.

TABLE 1

| Steel sample ID | C | Si | Mn | P | S | N | Al | B | Ti | Cr | Cu | Ni | Mo | [Si]/[Mn] | |
|---|---|---|---|---|---|---|---|---|---|---|---|---|---|---|---|
| A | 0.05 | 0.12 | 2.48 | 0.02 | 0.002 | 0.004 | 0.039 | 0.001 | 0.01 | — | — | — | — | 0.05 | Reference steel |
| B | 0.06 | 0.24 | 2.51 | 0.01 | 0.001 | 0.003 | 0.033 | 0.001 | 0.01 | — | — | — | — | 0.10 | Conforming steel |
| C | 0.12 | 0.51 | 2.54 | 0.03 | 0.002 | 0.005 | 0.037 | 0,001 | 0.01 | 0.60 | — | — | — | 0.20 | Conforming steel |
| D | 0.08 | 0.48 | 2.49 | 0.02 | 0.002 | 0.004 | 0.036 | 0.001 | 0.01 | — | 0.30 | — | — | 0.19 | Conforming steel |
| E | 0.09 | 0.53 | 2.48 | 0.02 | 0.002 | 0.006 | 0.038 | 0.001 | 0.01 | — | — | 0.20 | — | 0.21 | Conforming steel |
| F | 0.09 | 0.61 | 2.67 | 0.01 | 0.001 | 0.004 | 0.032 | 0.001 | 0.01 | — | — | — | — | 0.23 | Conforming steel |
| G | 0.13 | 0.59 | 2.69 | 0.01 | 0.001 | 0.003 | 0.034 | 0.001 | 0.01 | — | — | — | 0.10 | 0.22 | Conforming steel |
| H | 0.18 | 0.88 | 3.27 | 0.01 | 0.001 | 0.007 | 0.033 | 0.002 | 0.01 | — | — | — | — | 0.27 | Conforming steel |
| I | 0.15 | 1.14 | 3.31 | 0.01 | 0.001 | 0.003 | 0.035 | 0.003 | 0.01 | — | — | — | — | 0.34 | Reference steel |
| J | 0.09 | 0.38 | 1.52 | 0.01 | 0.001 | 0.004 | 0.037 | 0.004 | 0.01 | — | — | — | — | 0.25 | Reference steel |
| K | 0.08 | 0.52 | 1.79 | 0.01 | 0.001 | 0.004 | 0.034 | 0.005 | 0.01 | — | — | — | — | 0.29 | Conforming steel |
| L | 0.12 | 0.49 | 3.29 | 0.02 | 0.002 | 0.005 | 0.036 | 0.006 | 0.01 | — | — | — | — | 0.15 | Conforming steel |
| M | 0.11 | 0.48 | 3.66 | 0.03 | 0.002 | 0.004 | 0.036 | 0.007 | 0.01 | — | — | — | — | 0.13 | Comparative steel |
| N | 0.10 | 0.95 | 2.46 | 0.03 | 0.002 | 0.006 | 0.034 | 0.008 | 0.01 | — | — | — | — | 0.39 | Reference steel |

* Underlines indicate outside of appropriate range according to the present disclosure.

Following this, using a continuous hot-dip galvanizing apparatus including a DFF as the second heating zone that is divided into four groups (#1 to #4) where the three groups (#1 to #3) on the upstream side in the steel sheet moving direction are set as the earlier stage and the last zone (#4) is set as the latter stage as illustrated in FIG. 1, each steel strip was subjected to oxidation treatment in the earlier stage and the latter stage of the second heating zone under the conditions in Tables 2-1 and 2-2. Here, the air ratio of the atmosphere in the earlier stage was 1.15, and the air ratio of the atmosphere in the latter stage was 0.85. The steel strip was then subjected to reduction annealing under the conditions in Tables 2-1 and 2-2. The reduction annealing was performed for 85 sec. After cooling the steel strip to 440° C. to 550° C., the steel strip was subjected to hot-dip galvanizing treatment using a hot-dip galvanizing bath of 460° C. having effective Al concentration in bath: 0.197 mass % with the balance consisting of Zn and inevitable impurities. After this, the coating amount was adjusted to approximately 50 g/m$^2$ by gas wiping, to produce a sample of a high-strength hot-dip galvanized steel sheet (GI). Moreover, after performing the same oxidation and reduction annealing, the steel strip was subjected to hot-dip galvanizing treatment using a hot-dip galvanizing bath of 460° C. having effective Al concentration in bath: 0.132 mass % with the balance consisting of Zn and inevitable impurities and then the coating amount was adjusted to approximately 50 g/m$^2$ by gas wiping to obtain a high-strength hot-dip galvanized steel sheet, which was then subjected to alloying treatment at 520° C. for 20 sec to produce a sample of a high-strength galvannealed steel sheet (GA).

The surface appearance of the high-strength hot-dip galvanized steel sheet (GI) or high-strength galvannealed steel sheet (GA) thus obtained was evaluated. The measurement method and the evaluation method are as follows.

<Surface Appearance>

The appearance of the steel sheet surface was visually observed. In the case where the appearance had no non-coating defect, the appearance was evaluated as excellent. In the case where the appearance had no non-coating defect but was uneven, the appearance was evaluated as good. In the case where the appearance had a non-coating defect, the appearance was evaluated as poor. The appearance evaluated as excellent or good was regarded as pass.

The results are indicated in Tables 2-1 and 2-2 together with the production conditions. In the "evaluation" field in Tables 2-1 and 2-2, "good" indicates that Formula (1) was satisfied, and "poor" indicates that Formula (1) was not satisfied.

TABLE 2-1

| No. | Steel sample ID | Heating zone air ratio: Earlier stage | Heating zone air ratio: Latter stage | Steel strip delivery temperature T of heating zone (° C.) | Soaking zone $H_2$ concentration (%) | Soaking zone average temperature (° C.) | Soaking zone dew point DP (° C.) |
|---|---|---|---|---|---|---|---|
| 1 | A | 1.15 | 0.85 | 500 | 15 | 800 | −10 |
| 2 | A | 1.15 | 0.85 | 600 | 15 | 800 | −10 |
| 3 | A | 1.15 | 0.85 | 500 | 15 | 800 | −30 |
| 4 | A | 1.15 | 0.85 | 600 | 15 | 800 | −30 |
| 5 | B | 1.15 | 0.85 | 620 | 15 | 800 | −10 |
| 6 | B | 1.15 | 0.85 | 620 | 15 | 800 | −20 |
| 7 | B | 1.15 | 0.85 | 500 | 15 | 800 | −30 |
| 8 | B | 1.15 | 0.85 | 620 | 15 | 800 | −30 |
| 9 | B | 1.15 | 0.85 | 500 | 15 | 800 | −40 |
| 10 | B | 1.15 | 0.85 | 620 | 15 | 800 | −40 |
| 11 | C | 1.15 | 0.85 | 620 | 15 | 800 | −10 |
| 12 | C | 1.15 | 0.85 | 620 | 15 | 800 | −30 |
| 13 | D | 1.15 | 0.85 | 620 | 15 | 800 | −10 |
| 14 | D | 1.15 | 0.85 | 620 | 15 | 800 | −30 |
| 15 | E | 1.15 | 0.85 | 620 | 15 | 800 | −10 |
| 16 | E | 1.15 | 0.85 | 620 | 15 | 800 | −30 |
| 17 | F | 1.15 | 0.85 | 620 | 15 | 800 | −10 |
| 18 | F | 1.15 | 0.85 | 700 | 15 | 800 | −10 |
| 19 | F | 1.15 | 0.85 | 620 | 15 | 800 | −20 |
| 20 | F | 1.15 | 0.85 | 670 | 15 | 800 | −20 |
| 21 | F | 1.15 | 0.85 | 500 | 15 | 800 | −30 |
| 22 | F | 1.15 | 0.85 | 620 | 15 | 800 | −30 |
| 23 | F | 1.15 | 0.85 | 500 | 15 | 800 | −40 |
| 24 | F | 1.15 | 0.85 | 620 | 15 | 800 | −40 |
| 25 | G | 1.15 | 0.85 | 620 | 15 | 800 | −10 |
| 26 | G | 1.15 | 0.85 | 620 | 15 | 800 | −30 |
| 27 | H | 1.15 | 0.85 | 620 | 15 | 800 | −10 |
| 28 | H | 1.15 | 0.85 | 700 | 15 | 800 | −10 |
| 29 | H | 1.15 | 0.85 | 620 | 15 | 800 | −20 |
| 30 | H | 1.15 | 0.85 | 670 | 15 | 800 | −20 |
| 31 | H | 1.15 | 0.85 | 500 | 15 | 800 | −30 |
| 32 | H | 1.15 | 0.85 | 620 | 15 | 800 | −30 |
| 33 | H | 1.15 | 0.85 | 500 | 15 | 800 | −40 |
| 34 | H | 1.15 | 0.85 | 620 | 15 | 800 | −40 |

| No. | Left side of Formula (1) | Evaluation | Surface appearance: GI | Surface appearance: GA | Steel sheet strength TS (MPa): GI | Steel sheet strength TS (MPa): GA | Remarks |
|---|---|---|---|---|---|---|---|
| 1 | 243.6 | Poor | Excellent | Excellent | 742 | 735 | Reference Example |
| 2 | 172.7 | Poor | Excellent | Excellent | 748 | 742 | Reference Example |
| 3 | 182.4 | Poor | Excellent | Excellent | 745 | 738 | Reference Example |
| 4 | 111.5 | Good | Excellent | Excellent | 753 | 745 | Reference Example |
| 5 | 193.9 | Poor | Poor | Poor | 852 | 846 | Comparative Example |
| 6 | 181.5 | Poor | Poor | Poor | 847 | 843 | Comparative Example |
| 7 | 180.5 | Poor | Poor | Poor | 838 | 833 | Comparative Example |
| 8 | 132.7 | Good | Good | Good | 851 | 844 | Example |

TABLE 2-1-continued

| | | | | | | | |
|---|---|---|---|---|---|---|---|
| 9 | 136.1 | Good | Good | Good | 843 | 838 | Example |
| 10 | 88.3 | Good | Excellent | Excellent | 856 | 848 | Example |
| 11 | 177.6 | Poor | Poor | Poor | 1100 | 1091 | Comparative Example |
| 12 | 116.4 | Good | Excellent | Excellent | 1109 | 1102 | Example |
| 13 | 179.1 | Poor | Poor | Poor | 921 | 911 | Comparative Example |
| 14 | 117.9 | Good | Excellent | Excellent | 919 | 914 | Example |
| 15 | 171.8 | Poor | Poor | Poor | 989 | 981 | Comparative Example |
| 16 | 110.6 | Good | Excellent | Excellent | 992 | 988 | Example |
| 17 | 169.4 | Poor | Poor | Poor | 993 | 985 | Comparative Example |
| 18 | 136.4 | Good | Good | Good | 1016 | 1013 | Example |
| 19 | 157.0 | Poor | Poor | Poor | 999 | 992 | Comparative Example |
| 20 | 139.5 | Good | Good | Good | 1015 | 1008 | Example |
| 21 | 127.0 | Good | Good | Good | 990 | 981 | Example |
| 22 | 108.2 | Good | Excellent | Excellent | 998 | 995 | Example |
| 23 | 82.6 | Good | Excellent | Excellent | 986 | 982 | Example |
| 24 | 63.8 | Good | Excellent | Excellent | 1001 | 991 | Example |
| 25 | 173.5 | Poor | Poor | Poor | 1103 | 1094 | Comparative Example |
| 26 | 112.3 | Good | Excellent | Excellent | 1105 | 1099 | Example |
| 27 | 153.6 | Poor | Poor | Poor | 1312 | 1305 | Comparative Example |
| 28 | 130.8 | Good | Good | Good | 1322 | 1318 | Example |
| 29 | 141.2 | Poor | Poor | Poor | 1313 | 1304 | Comparative Example |
| 30 | 129.1 | Good | Good | Good | 1319 | 1313 | Example |
| 31 | 105.5 | Good | Excellent | Excellent | 1294 | 1290 | Example |
| 32 | 92.4 | Good | Excellent | Excellent | 1308 | 1302 | Example |
| 33 | 61.1 | Good | Excellent | Excellent | 1299 | 1292 | Example |
| 34 | 48.0 | Good | Excellent | Excellent | 1306 | 1299 | Example |

Underlines indicate outside of appropriate range according to the present disclosure.

TABLE 2-2

| No. | Steel sample ID | Heating zone air ratio Earlier stage | Heating zone air ratio Latter stage | Steel strip delivery temperature T of heating zone (° C.) | Soaking zone $H_2$ concentration (%) | Soaking zone average temperature (° C.) | Soaking zone dew point DP (° C.) |
|---|---|---|---|---|---|---|---|
| 35 | I | 1.15 | 0.85 | 670 | 15 | 800 | −5 |
| 36 | I | 1.15 | 0.85 | 670 | 15 | 800 | −10 |
| 37 | I | 1.15 | 0.85 | 670 | 15 | 800 | −25 |
| 38 | I | 1.15 | 0.85 | 670 | 15 | 800 | −40 |
| 39 | J | 1.15 | 0.85 | 500 | 15 | 800 | −10 |
| 40 | J | 1.15 | 0.85 | 620 | 15 | 800 | −10 |
| 41 | J | 1.15 | 0.85 | 500 | 15 | 800 | −30 |
| 42 | J | 1.15 | 0.85 | 620 | 15 | 800 | −30 |
| 43 | K | 1.15 | 0.85 | 500 | 15 | 800 | −10 |
| 44 | K | 1.15 | 0.85 | 600 | 15 | 800 | −10 |
| 45 | K | 1.15 | 0.85 | 620 | 15 | 800 | −10 |
| 46 | K | 1.15 | 0.85 | 620 | 15 | 800 | −20 |
| 47 | K | 1.15 | 0.85 | 500 | 15 | 800 | −30 |
| 48 | K | 1.15 | 0.85 | 620 | 15 | 800 | −30 |
| 49 | K | 1.15 | 0.85 | 500 | 15 | 800 | −40 |
| 50 | K | 1.15 | 0.85 | 620 | 15 | 800 | −40 |
| 51 | L | 1.15 | 0.85 | 620 | 15 | 800 | −10 |
| 52 | L | 1.15 | 0.85 | 750 | 15 | 800 | −10 |
| 53 | L | 1.15 | 0.85 | 620 | 15 | 800 | −20 |
| 54 | L | 1.15 | 0.85 | 750 | 15 | 800 | −20 |
| 55 | L | 1.15 | 0.85 | 620 | 15 | 800 | −30 |
| 56 | L | 1.15 | 0.85 | 670 | 15 | 800 | −30 |
| 57 | L | 1.15 | 0.85 | 500 | 15 | 800 | −40 |
| 58 | L | 1.15 | 0.85 | 620 | 15 | 800 | −40 |
| 59 | M | 1.15 | 0.85 | 620 | 15 | 800 | −5 |
| 60 | M | 1.15 | 0.85 | 620 | 15 | 800 | −10 |
| 61 | M | 1.15 | 0.85 | 620 | 15 | 800 | −25 |
| 62 | M | 1.15 | 0.85 | 620 | 15 | 800 | −40 |

TABLE 2-2-continued

| | | | | | | | |
|---|---|---|---|---|---|---|---|
| 63 | N | 1.15 | 0.85 | 670 | 15 | 800 | −5 |
| 64 | N | 1.15 | 0.85 | 670 | 15 | 800 | −10 |
| 65 | N | 1.15 | 0.85 | 670 | 15 | 800 | −25 |
| 66 | N | 1.15 | 0.85 | 670 | 15 | 800 | −40 |

| No. | Left side of Formula (1) | Evaluation | Surface appearance GI | Surface appearance GA | Steel sheet strength TS (MPa) GI | Steel sheet strength TS (MPa) GA | Remarks |
|---|---|---|---|---|---|---|---|
| 35 | 78.3 | Good | Excellent | Excellent | 1199 | 1191 | Reference Example |
| 36 | 98.5 | Good | Good | Good | 1197 | 1193 | Reference Example |
| 37 | 63.7 | Good | Poor | Poor | 1196 | 1187 | Reference Example |
| 38 | −7.1 | Good | Poor | Poor | 1203 | 1195 | Reference Example |
| 39 | 171.8 | Poor | Good | Good | 607 | 602 | Reference Example |
| 40 | 141.6 | Poor | Excellent | Excellent | 611 | 606 | Reference Example |
| 41 | 110.6 | Good | Good | Good | 622 | 615 | Reference Example |
| 42 | 80.4 | Good | Excellent | Excellent | 618 | 611 | Reference Example |
| 43 | 160.8 | Poor | Poor | Poor | 623 | 615 | Comparative Example |
| 44 | 144.4 | Poor | Poor | Poor | 622 | 618 | Comparative Example |
| 45 | 138.7 | Good | Good | Good | 628 | 621 | Example |
| 46 | 126.3 | Good | Good | Good | 624 | 619 | Example |
| 47 | 99.6 | Good | Excellent | Excellent | 623 | 617 | Example |
| 48 | 77.5 | Good | Excellent | Excellent | 630 | 623 | Example |
| 49 | 55.2 | Good | Excellent | Excellent | 627 | 620 | Example |
| 50 | 33.1 | Good | Excellent | Excellent | 631 | 625 | Example |
| 51 | 217.8 | Poor | Poor | Poor | 1060 | 1055 | Comparative Example |
| 52 | 128.3 | Good | Good | Good | 1094 | 1086 | Example |
| 53 | 205.4 | Poor | Poor | Poor | 1063 | 1058 | Comparative Example |
| 54 | 115.9 | Good | Excellent | Excellent | 1095 | 1088 | Example |
| 55 | 156.6 | Poor | Poor | Poor | 1062 | 1055 | Comparative Example |
| 56 | 134.8 | Good | Good | Good | 1071 | 1067 | Example |
| 57 | 135.6 | Good | Good | Good | 1059 | 1051 | Example |
| 58 | 112.2 | Good | Excellent | Excellent | 1072 | 1064 | Example |
| 59 | 217.4 | Poor | Poor | Poor | 1077 | 1071 | Comparative Example |
| 60 | 237.6 | Poor | Poor | Poor | 1071 | 1066 | Comparative Example |
| 61 | 202.8 | Poor | Poor | Poor | 1077 | 1068 | Comparative Example |
| 62 | 132.0 | Good | Poor | Poor | 1075 | 1070 | Comparative Example |
| 63 | 69.1 | Good | Excellent | Excellent | 1036 | 1033 | Reference Example |
| 64 | 89.3 | Good | Good | Good | 1036 | 1028 | Reference Example |
| 65 | 54.5 | Good | Poor | Poor | 1040 | 1035 | Reference Example |
| 66 | −16.3 | Good | Poor | Poor | 1029 | 1022 | Reference Example |

Underlines indicate outside of appropriate range according to the present disclosure.

As is clear from the results in Tables 2-1 and 2-2, in each Example, even though a high-strength steel sheet containing Mn at a predetermined ratio or more to Si was subjected to coating, favorable surface appearance was achieved. In each Comparative Example produced under the conditions outside of the range according to the present disclosure, the surface appearance was inferior. In Reference Examples No. 39 to 42 in which the Mn content was less than 1.7%, a large amount of Mn single oxide did not form because of low Mn content, and favorable surface appearance was achieved without applying the presently disclosed techniques. In Reference Examples No. 35 to 39 and 63 to 66 in which [Si]/[Mn] was more than 0.30, the oxide precipitation form was different from when [Si]/[Mn]≤0.30 as described above with reference to FIGS. 2A to 2D and 3, and accordingly there is some discrepancy between the evaluation and the surface appearance. In Reference Examples No. 1 to 4 in which the Si content was less than 0.2%, a sufficient amount of iron oxide was formed by oxidation treatment because of low Si content, and favorable surface appearance was achieved without applying the presently disclosed techniques.

INDUSTRIAL APPLICABILITY

The method of producing a high-strength hot-dip galvanized steel sheet according to the present disclosure can provide high-strength hot-dip galvanized steel sheets that have excellent surface appearance and enable automotive bodies to be made more lightweight and stronger.

REFERENCE SIGNS LIST

100 continuous hot-dip galvanizing apparatus
10 heating zone
10A first heating zone
10B second heating zone (direct fired furnace)
11 hearth roll
12 soaking zone
14, 16 cooling zone
18 snout
20 annealing furnace
22 hot-dip galvanizing bath
23 alloying line
P steel strip
30 coating layer
31 Si—Mn surface oxide
32 Si—Mn internal oxide
33 Mn single oxide

The invention claimed is:

1. A method of producing a hot-dip galvanized steel sheet using a continuous hot-dip galvanizing apparatus including an annealing furnace in which a heating zone, a soaking zone, and a cooling zone are arranged side by side in the stated order and a hot-dip galvanizing line located downstream of the cooling zone, the method comprising:

subjecting a steel strip to annealing, by conveying the steel strip in the annealing furnace in an order of the heating zone, the soaking zone, and the cooling zone; and subjecting the steel strip discharged from the cooling zone to hot-dip galvanizing using the hot-dip galvanizing line, to obtain a hot-dip galvanized steel sheet, wherein the steel strip has a chemical composition containing, in mass %, Mn: 1.7% or more and 3.5% or less and Si: 0.4% or more and 1.05% or less and satisfying [Si]/[Mn]≤0.30, and the chemical composition, a dew point of an atmosphere in the soaking zone, and a delivery temperature of the heating zone satisfy the following Formula (1):

$$A\times 50+B-C/30<140 \quad (1)$$

where A=[Mn]−[Si]×4, $B=-0.0068\times(D.P.)^3-0.59\times(D.P.)^2-11.7\times(D.P.)+120$, C=exp(T/100)/[Si],

[Si] is a concentration of Si in mass %, [Mn] is a concentration of Mn in mass %, D.P. is the dew point of the atmosphere in the soaking zone in ° C. where −50° C.<D.P.<−5° C., and T is the delivery temperature of the heating zone for the steel strip in ° C. where 400° C.<T<850° C.

2. The method of producing a hot-dip galvanized steel sheet according to claim 1, wherein the heating zone includes a direct fired furnace divided into an earlier stage and a latter stage, an air ratio of an atmosphere in the earlier stage is 1.0 or more and less than 1.3, and an air ratio of an atmosphere in the latter stage is 0.7 or more and less than 1.0.

3. The method of producing a hot-dip galvanized steel sheet according to claim 1, wherein in the soaking zone, the steel strip is subjected to reduction annealing in a temperature range of 700° C. or more and 900° C. or less for 10 sec or more and 300 sec or less, with a hydrogen concentration of the atmosphere in the soaking zone being 5 vol % or more and 30 vol % or less.

4. The method of producing a hot-dip galvanized steel sheet according to claim 1, further comprising subjecting, after the hot-dip galvanizing, the hot-dip galvanized steel sheet to alloying treatment of heating in a temperature range of 460° C. or more and 600° C. or less for 10 sec or more and 60 sec or less.

5. The method of producing a hot-dip galvanized steel sheet according to claim 1, wherein the chemical composition further contains, in mass %, C: 0.8% or less,
P: 0.1% or less,
S: 0.03% or less,
Al: 0.1% or less,
B: 0.005% or less, and
Ti: 0.2% or less,
with a balance consisting of Fe and inevitable impurities.

6. The method of producing a hot-dip galvanized steel sheet according to claim 1, wherein the chemical composition further contains, in mass %, one or more selected from the group consisting of N: 0.010% or less,
Cr: 1.0% or less,
Cu: 1.0% or less,
Ni: 1.0% or less,
Mo: 1.0% or less,
Nb: 0.20% or less,
V: 0.5% or less,
Sb: 0.200% or less,
Ta: 0.1% or less,
W: 0.5% or less,
Zr: 0.1% or less,
Sn: 0.20% or less,
Ca: 0.005% or less,
Mg: 0.005% or less, and
REM: 0.005% or less.

7. The method of producing a hot-dip galvanized steel sheet according to claim 1, wherein D.P. and T are controlled based on a concentration of Si and a concentration of Mn of each of a plurality of types of steel strips having different chemical compositions each within a range of the chemical composition so that all of the steel strips will satisfy the Formula (1).

8. The method of producing a hot-dip galvanized steel sheet according to claim 1, wherein D.P. is −30° C. or less.

* * * * *